US006527046B1

(12) United States Patent
White

(10) Patent No.: US 6,527,046 B1
(45) Date of Patent: Mar. 4, 2003

(54) HEAT EXCHANGER, PARTICULARLY OIL COOLER

(75) Inventor: Grover Richard White, Elon College, NC (US)

(73) Assignee: AKG of America, Inc., Mebane, NC (US)

( * ) Notice: Subject to any disclaimer, the term of this patent is extended or adjusted under 35 U.S.C. 154(b) by 0 days.

(21) Appl. No.: 09/475,938

(22) Filed: Dec. 30, 1999

(30) Foreign Application Priority Data

Jun. 2, 1999 (DE) ..... 299 09 871

(51) Int. Cl.[7] ..... F28F 27/00; F28F 27/02; F28D 1/04

(52) U.S. Cl. ..... 165/297; 165/298; 165/144; 165/145; 165/100; 165/101; 165/96; 165/916

(58) Field of Search ..... 165/144, 145, 165/101, 96, 297, 298, 916, 100

(56) References Cited

U.S. PATENT DOCUMENTS

| | | | | | |
|---|---|---|---|---|---|
| 1,320,755 | A | * | 11/1919 | Grikscheit | 165/101 |
| 1,510,807 | A | * | 10/1924 | Soule | 165/144 |
| 2,162,148 | A | * | 6/1939 | Wilson et al. | 165/101 |
| 2,373,157 | A | * | 4/1945 | Worth | 165/298 |
| 2,539,669 | A | * | 1/1951 | Newcomer et al. | |
| 2,703,680 | A | * | 3/1955 | Nallinger | |
| 2,778,606 | A | * | 1/1957 | Lloyd et al. | 165/297 |
| 2,984,456 | A | * | 5/1961 | Young | 165/145 |
| 3,034,770 | A | * | 5/1962 | Hiersch | 165/297 |
| 3,376,917 | A | * | 4/1968 | Fristoe et al. | 165/145 |
| 3,598,179 | A | * | 8/1971 | Giauque | 165/145 |
| 4,156,408 | A | * | 5/1979 | Protze | 165/297 |
| 4,487,364 | A | * | 12/1984 | Okulicz et al. | 237/12.3 R |
| 5,024,377 | A | * | 6/1991 | Harrison | 237/12.3 R |
| 5,101,640 | A | * | 4/1992 | Fukushima et al. | 62/196.4 |
| 5,176,200 | A | * | 1/1993 | Shinmura | 165/144 |

FOREIGN PATENT DOCUMENTS

| | | | | |
|---|---|---|---|---|
| DE | 744 857 | | 5/1943 | |
| DE | 3203109 | * | 8/1983 | 165/145 |
| DE | 84 03 955.8 | | 5/1984 | |
| DE | 44 03 713 A1 | | 8/1995 | |
| DE | 196 26 639 C1 | | 11/1997 | |
| DE | 297 19 311.2 | | 3/1999 | |
| DE | 297 19 311 U1 | | 4/1999 | |
| EP | 0 450 425 A2 | | 10/1991 | |
| GB | 306010 | * | 2/1929 | 165/101 |
| JP | 0064507 | * | 5/1977 | 165/145 |
| JP | 0254263 | * | 10/1990 | 62/196.4 |
| JP | 404212617 | * | 8/1992 | 62/196.4 |

* cited by examiner

*Primary Examiner*—John K. Ford
(74) *Attorney, Agent, or Firm*—Michael J. Striker

(57) ABSTRACT

A heat exchanger has a core provided with passages for a liquid to keep cool and passages for a cooling medium, a first collection tank for supplying the liquid, a second collection tank for withdrawing the liquid, at least one third collection tank, the core being divided into at least two sections through which the liquid successively flows and which are interconnected by the at least one third collection tank, one of the sections being connected with the first collection tank, while the other of the sections being connected with the second collection tank, a bypass line connected with the third collection tank and in parallel with the other sections, and structure for activating and deactivating the bypass lines.

12 Claims, 4 Drawing Sheets

HEAT EXCHANGER, PARTICULARLY OIL COOLER

BACKGROUND OF THE INVENTION

The invention relates to a heat exchanger, particularly an oil cooler, having a core provided with passages for a liquid to be cooled and passages for a cooling medium, and having a first collection tank for supplying the liquid and a second collection tank for withdrawing the same.

Heat exchangers of this type are known in many different embodiments and, in particular, in connection with motor vehicles (e.g. DE 297 19 311 U1). The liquid to be cooled is typically water or oil.

In addition, heat exchangers of this type are used to cool, for example, the oil of motors or compressors that are primarily operated in the open air and may be exposed to a wide range of ambient temperatures, for example, 55° C. to −40° C., depending on application and location. The object is to cool the oil, which is delivered at a temperature of perhaps 150° C., by about 40–50° C., i.e., to a temperature of approximately 100 to 110° C. Thus, the cooling capacity must be selected in such a way that the desired cooling of the oil is reliably ensured even at the highest possible outside temperature. The disadvantage, however, is that the cooling capacity of said cooler is significantly overdimensioned at temperatures far below the freezing point and the oil is cooled more than necessary.

A further problem is due the fact that the viscosity of the typically used oils strongly depends on the temperature so that the flow properties of the oil are not optimal over the entire indicated temperature range. Since the oils becomes increasingly thick with decreasing temperatures, its flow resistance in the oil-carrying passages of the heat exchanger continues to increase with increasing cold. The flow resistance may become so great that the heat exchanger is completely or partially destroyed, particularly if the oil passages are equipped with turbulators that are intended to introduce turbulence into the flowing oil to enhance heat exchange.

Since heat exchangers of the type initially described are to be produced and sold irrespective of the climatic conditions in which they are used, attempts have been made to prevent said problem by connecting a thermostat-controlled bypass line in parallel, similar to motor vehicle radiators, to take up the oil flow as long as the oil is at a temperature below its operating temperature, whereas after reaching the operating temperature, the oil is guided through the heat exchanger. This measure alone is not sufficient, however, because it does not take into consideration the fact that the oil does not only become thicker at low temperatures but may even gel. Thus, if the operating conditions are such that the oil is cooled significantly at the instant when the bypass line is disconnected, the oil my gel, particularly in those passages where the cooling effect is particularly good. The flow rate of the oil then decreases significantly and drops practically to zero, while the flow rate in those passages where cooling is less effective is affected to a lesser extent. The resulting temperature differences in the heat exchanger have the effect that the hotter parts of the heat exchangers expand more than the cooler parts, which causes thermal stresses that gradually damage the structure of the walls defining the passages and ultimately cause cracks therein. As a result, the heat exchanger leaks and becomes unusable.

Finally, attempts have been made to prevent this problem in providing the heat exchanger with louvers that may be rolled up and down or by regulating the heat exchanger capacity. But such measures have thus far proven to be unsatisfactory because of their susceptibility to failure and their considerable cost.

SUMMARY OF THE INVENTION

It is, therefore, an object underlying this invention to design a heat exchanger mentioned above such that its cooling capacity can be adapted to the ambient temperatures.

A further object of this invention is to provide the heat exchanger mentioned above with simple and inexpensive means which makes possible to adapt the cooling capacity to the ambient temperature in a manner to counterbalance the oil gelling problems.

Yet another object of this invention is to design the heat exchanger such that destructions of the heat exchanger at very low temperatures as a result of congealing problems of the liquid to be cooled are largely prevented.

These and other objects of this invention are solved by a heat exchanger of the type mentioned above and having a core which is divided at least in two sections through which the liquid successively flows and which are interconnected by at least one third collection tank, wherein one of the sections is connected with the first collection tank and another one of the sections is connected with the second collection tank. The other section is also connected in parallel with a bypass line, which is connected with the third collection tank and can be connected or disconnected by means of a valve.

The invention is based on the idea of operating the heat exchanger at full capacity and with the entire usable length of the existing oil passages only at temperatures above a critical value. If the temperature is below a critical value, the bypass line is connected in order to take a section of the oil passages largely out of operation, reduce the cooling surface and decrease the capacity of the heat exchanger to a value sufficient for lower outside temperatures. If the outside temperatures rise again, the bypass line is disconnected again.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
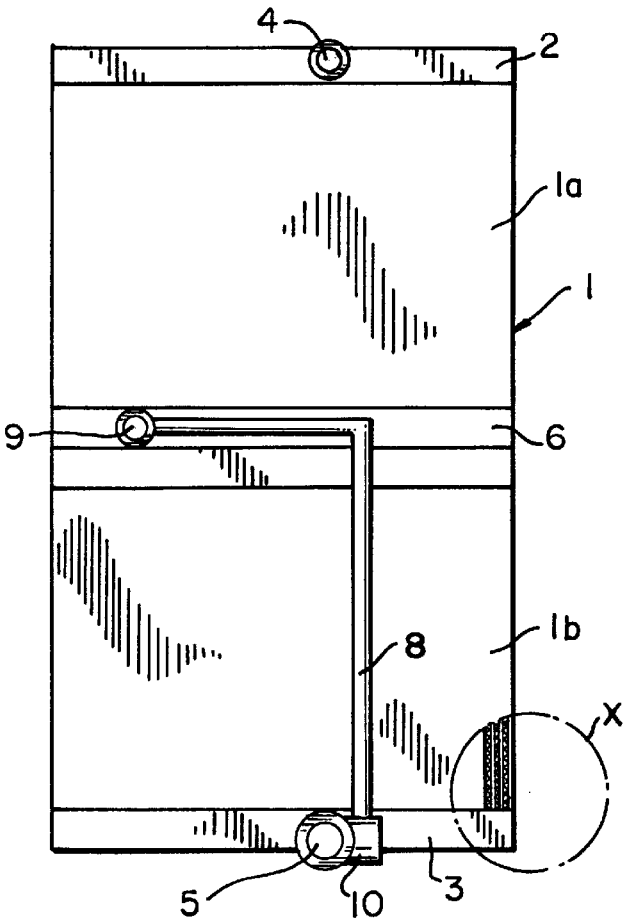
FIG. 1 is a front view of a heat exchanger designed in accordance with the invention.
Figure 2:
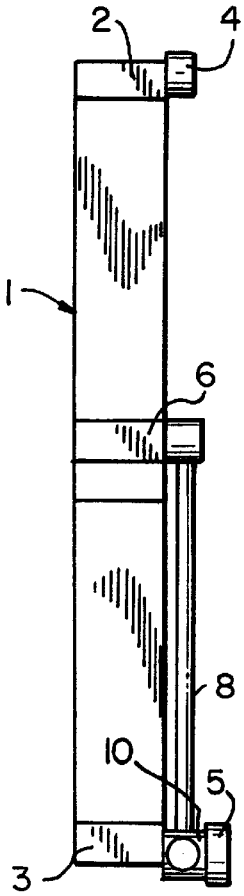
FIG. 2 is a side view of the inventive heat exchanger according to FIG. 1.

According to FIGS. 1 through 6, an inventive heat exchanger comprises a heat exchanger core 1 connected with a first collection tank 2 for supplying a liquid to be cooled, e.g., oil, and a second collection tank 3 for withdrawing said liquid. Furthermore, the collection tank 2 is provided with an intake line 4 and the collection tank 3 is provided with an outlet line 5 for the oil. According to the invention, the core 1 is divided into two sections 1*a* and 1*b*, whereby the section 1*a* is connected with the collection tank 2 on an intake side and the section 1*b* with the collection tank 3 on an outlet side. The two sections 1*a*, 1*b* are interconnected by a third collection tank 6.

Figure 3:
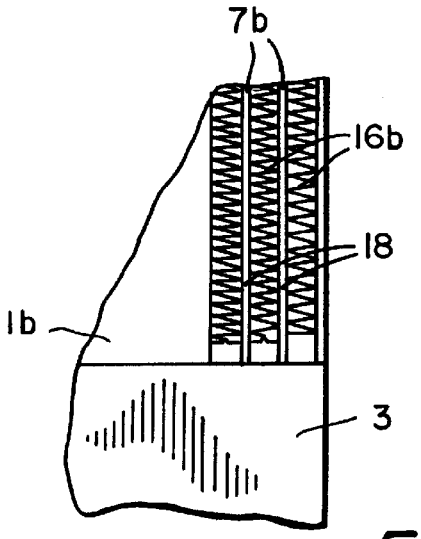
FIG. 3 is an enlarged detail X of the inventive heat exchanger of FIG. 1.
Figure 4:
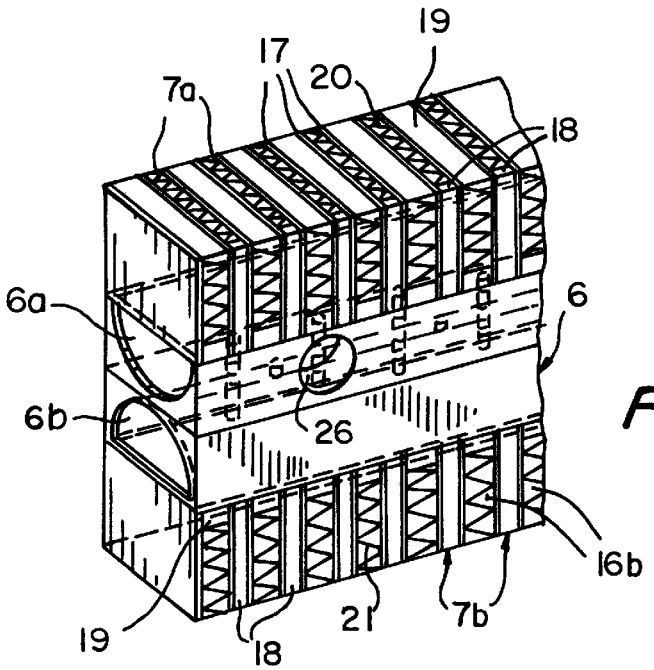
FIG. 4 is a schematic perspective view of an inventive partitioning of the heat exchanger core into two sections according to FIG. 1.
Figure 5:
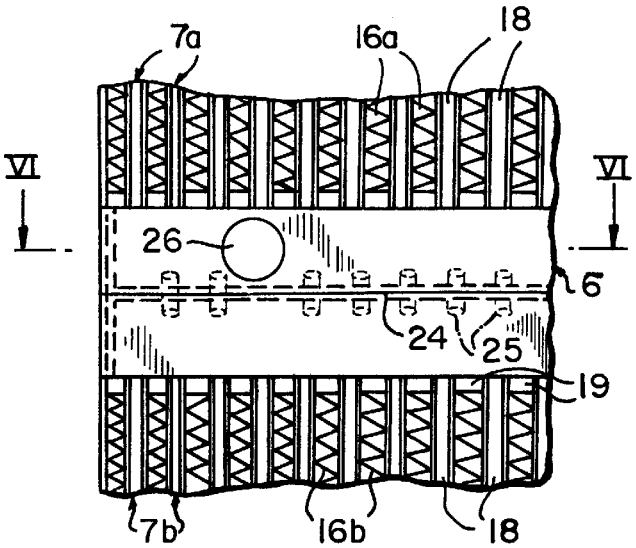
FIG. 5 is a front view of a portion of the core of the inventive heat exchanger according to FIG. 4.

As shown particularly in FIGS. 3 through 5, the sections 1*a*, 1*b* of core 1 are each provided with a plurality of first passages 7*a* and 7*b* for the liquid. The passages 7*a* have intake ends that open into the collection tank 2 and outlet ends that open into the collection tank 6, and the passages 7*b* have intake ends that open into the collection tank 6 and outlet ends that open into the collection tank 3. Consequently, the liquid to be cooled normally flows into collection tank via an intake line 4, then reaches the passages 7*a* and from there the collection tank 6 from where it flows into the passages 7*b* and from there into the collection tank 3 before leaving the collection tank 3 through an outlet line 5.

Parallel to the section 1*b* of the core 1, the heat exchanger is equipped with a bypass line 8 provided at its one end with a connection 9 that opens into the collection tank 6. Another end of the bypass line 8 may open into the liquid flow coming from the section 1*b* in any manner per se. In the exemplary embodiment this is accomplished with the aid of a valve 10 (see particularly FIGS. 8 and 9).

Figure 8:
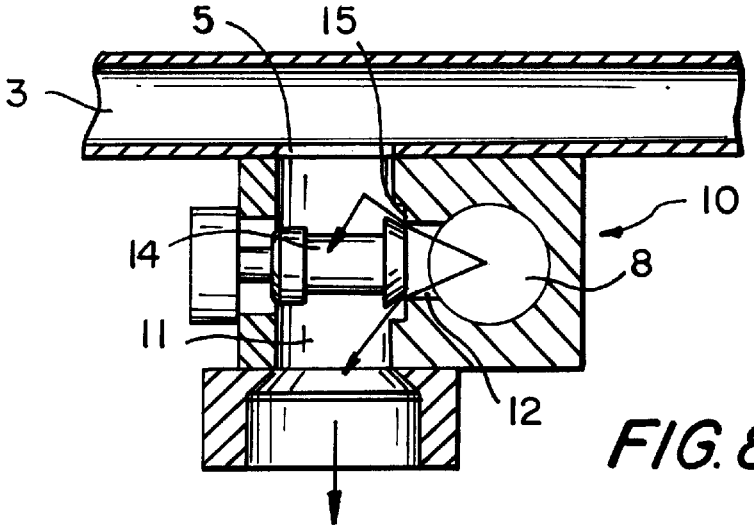
FIGS. 8 and 9 each are section through a valve installed in a bypass line of the heat exchanger according to FIG. 1 at a larger scale and in different operating states.
Figure 9:
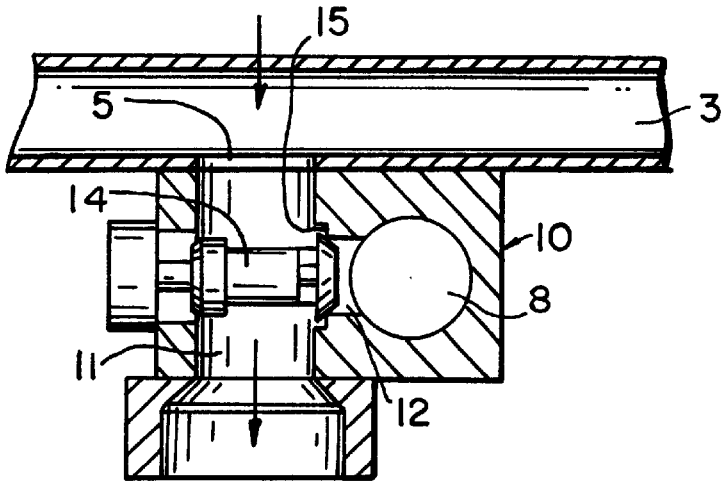
Figure 10:
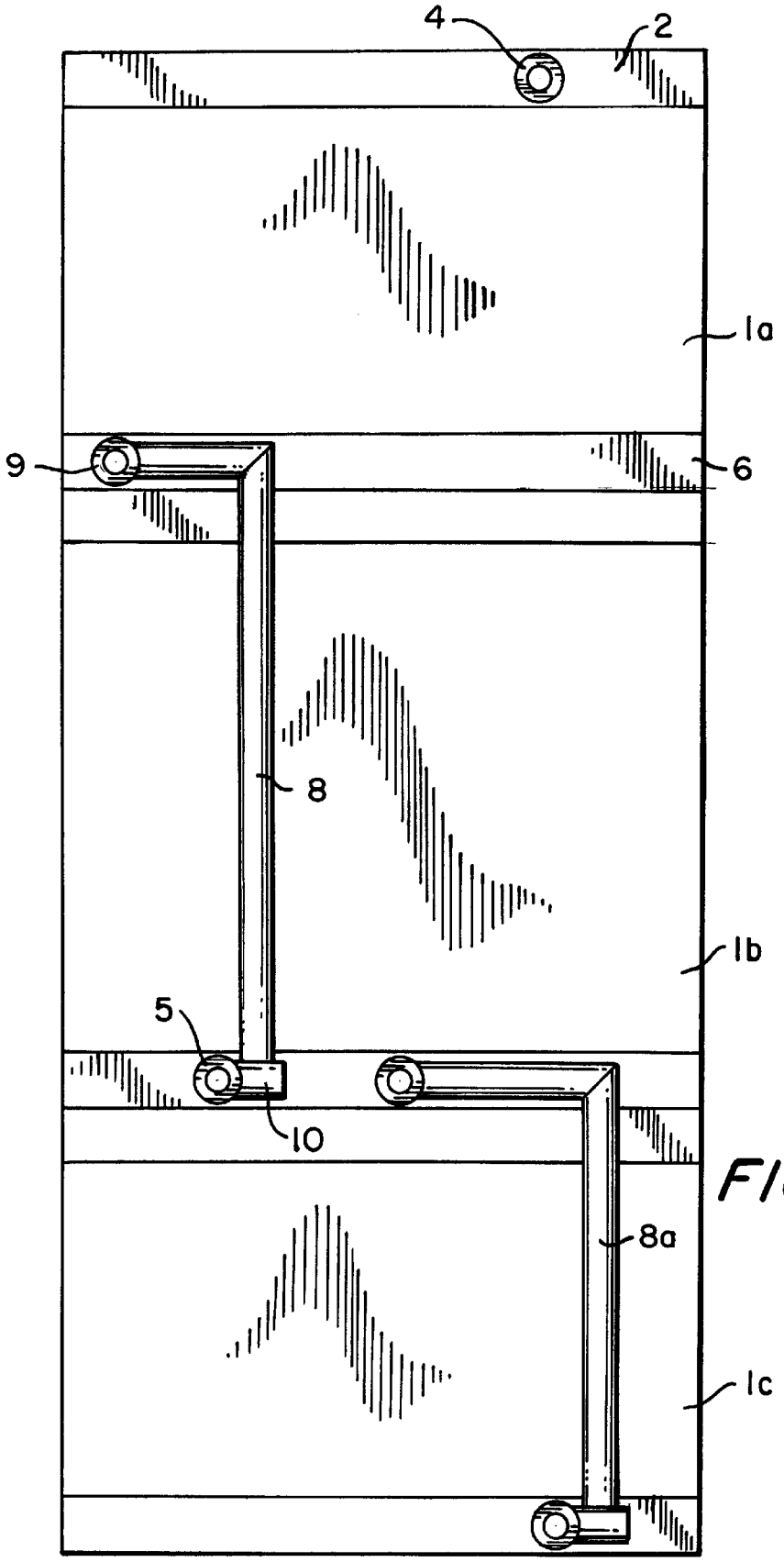

The valve 10 is equipped with a main passage 11 that is continuously open and is connected to the outlet line 5 and with a secondary passage 12 connecting the bypass line 8 with main passages 11. The secondary passage 12 may be opened and closed as required by means of a valve body 14. FIG. 8 shows the open position in which the valve body 14 is lifted from a valve seat 15 at the end of the secondary passage 12. FIG. 9 shows its closed position in which the valve body 14 is pressed against a valve seat 15 and thus blocks the secondary passage 12 toward the main passage 11. Thus, in the open position of the valve 10, the bypass line is connected with the heat exchanger while in the closed position of the valve 10 it is disconnected and ineffective with respect to the heat exchanger.

A plurality of second passages 16*a* and 16*b* serve to cool the liquid. The passages 16*a* in section 1*a* are arranged between two each passages 7*a* while the passages 16*b* in section 1*b* are arranged between two each passages 7*b*, preferably in such a way that a cooling medium flowing through them, e.g. air, flows through the heat exchanger in a direction that is substantially perpendicular to the direction in which the liquid to be cooled flows through the heat exchanger.

The core 1, or its sections 1*a*, 1*b*, has preferably a plate structure, i.e., it is assembled from plates 17 arranged parallel to each other. At their ends, the plates 17 are spaced at a distance from each other in a manner known per se by profiles 18 delimiting the first passages 7*a*, 7*b*, and profiles 19 delimiting the second passages 16*a*, 16*b*. Turbulators 20 may be installed in the passages 7*a*, 7*b* to generate turbulence in the flowing liquid and thus to enhance its heat exchange with the surrounding wall segments. Correspondingly, lamellas 21 may be installed in the passages 16*a*, 16*b*, particularly to enlarge the effective surface of the passages through which the cooling medium flows for heat-exchange. The liquid-tight interconnection of the various elements is preferably made by brazing.

Figure 7:
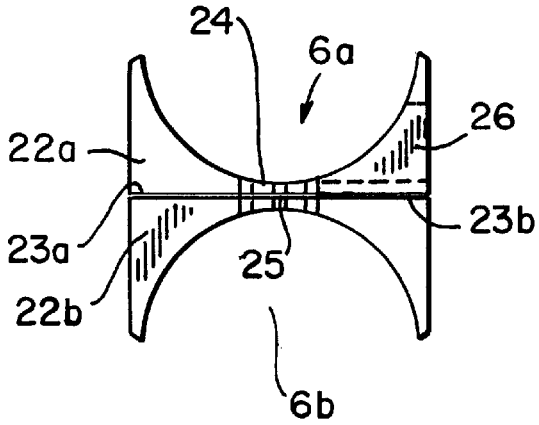
FIG. 7 is a side view of a partition of the heat exchanger according to FIG. 4.

As shown particularly in FIGS. 4 and 7, the third collection tank 6 is divided into two parts 6*a*, 6*b*. In the exemplary embodiment, these two parts are formed by partition members 22*a*, 22*b* connected with each other and with the sections 1*a*, 1*b* by brazing. Each of these partition members is basically U-shaped in cross section and has a mainly flat underside 23*a*, 23*b*. Both undersides 23*a*, 23*b* adjoin each other such that the partition members 22*a*, 22*b* are opens in U-shape on the opposite sides (FIG. 7) to form parts 6*a*, 6*b* of the collection tank 6. In FIG. 4, the part 6*a* is delimited in upward direction by the section 1*a*, while the part 6*b* is delimited in downward direction by the section 1*b* of the core 1 such that the ends of passages 7*a*, 7*b* facing toward the parts 6*a*, 6*b* directly open into said parts 6*a*, 6*b*. The lateral boundaries for the parts 6*a*, 6*b* of the collection tank 6 are not shown in FIG. 4 to open the view onto the parts 6*a*, 6*b*.

Figure 6:
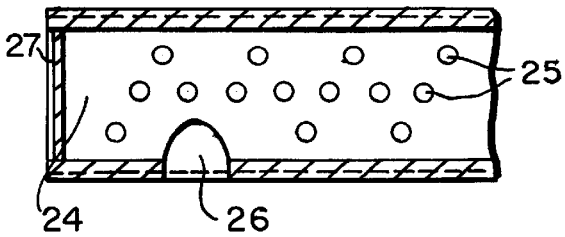
FIG. 6 is a section of the inventive heat exchanger along VI—VI of FIG. 5.

The floors having the undersides 23*a*, 23*b* of partition members 22*a* and 22*b* form a partition 24, which is substantially closed except for a number of through-holes 25 (see also FIGS. 5, 6). Furthermore, in the exemplary embodiment, the upper partition member 22*a* is provided with lateral opening 26 that is connected with the connection 9 (FIGS. 1, 2) for the bypass line 8.

The described heat exchanger basically works as follows:

At sufficiently warm temperatures above the freezing temperature of water, the valve 10 is in its closed position as shown in FIG. 9 so that the bypass line 8 is closed. Liquid flowing in through the intake line 4 thus flows through the heat exchanger from the collection tank 2 to the collection tank 3 and its outlet line 5 exactly as if the bypass line 8 and the collection tank 6 did not exist.

At lower temperatures, particularly below 0° C., at which there is a risk that the oil may gel, the valve 10 is brought into its open position as shown in FIG. 8 so that the bypass 8 is connected parallel to the portion 6*b*. A portion of the oil flowing into through the intake line 4 now flows through the third collection tank 6 into the bypass line 8 and through there through the valve 10 into the outlet line 5. This oil portion is all the greater, the greater the cross section of the bypass line 8 is as compared to the cross section of the outlet line 5. This makes it possible that nearly all oil flowing into the collection tank 6 flows through the bypass line 8 and not through the second section 1*b* of the core 1. If, in a preferred arrangement of the invention, the bypass line 8 including the valve 10 is disposed substantially outside the flow area of the cooling medium flowing through the passages 16*a*, 16*b* or if the bypass line 8 is made of or enclosed in a thermal insulating material, there is almost no heat exchange within the bypass line 8 so that practically only the upper section 1*a* shown in FIG. 1 is available for heat exchange. The cooling capacity at colder temperatures is thus significantly reduced compared to the cooling capacity at warmer temperatures. As a result cooling that would result in gelling in winter is avoided, while the full capacity required in summer is available.

In principle, the valve 10 may be actuated in any manner, even manually, for example in function of the ambient temperature. It is considered best, however, if this valve is a thermostatic valve that is actuated in function of the temperatures in the lines 5 and/or 8. The thermostatic valve may be a component, generally known from motor vehicles, which opens or closes in function of the temperature of the flowing medium. For this purpose, valve 10 is provided, for example, with an expansion element that displaces the valve body 14 in function of the temperature and its expansion behavior toward the valve seat 15 or away therefrom. In the case of the invention, this thermostatic valve is preferably designed such that it passes from one state to the other not abruptly but gradually across a relatively wide temperature range, for example 20° C. Said temperature range may lie between +10° C. and −10° C., as an example.

Since the oil flow is largely guided parallel to and around section 1*b* of core 1 when bypass line 8 is connected, its behavior in section 1*b* is relatively unimportant. Whether or not the oil congeals in this section 1*b*, thermal stresses that significantly affect the durability of the heat exchanger do not occur. Even if the oil flow comes nearly to a standstill in all passages 7*b* because here the oil is very thick, the oil flow is passages 7*a* is hardly impeded so that the oil is sufficiently cooled in these passages as usual. However, when valve 10 is moved to its closed position at warmer temperatures, the oil is sufficiently thin again so that it flows easily through passages 7*b*.

Furthermore, the occurrence of thermal stresses can be counteracted by a suitable hole pattern in partition 24, particularly in section 1*b* of core 1. As shown particularly in FIG. 6, holes 25 are preferably disposed in such a way that in the region of side walls 27 (FIG. 6) of collection tank 6, i.e., in the colder zones, there are only a few holes 25 to reduce the cooling effect at that location. The hole pattern may furthermore be used to distribute the oil flow to passages 7*b* located in section 1*b* as a function of the flow conditions resulting in the individual case so that thermal stresses are largely prevented.

In the exemplary embodiment that is currently considered optimal, the cross-sectional area of the two lines 4,5 are substantially equal in size and each is as large as the sum of the cross-section areas of holes 25, whereby all holes 25 have preferably the same cross section. In contrast, bypass line 8 has a smaller cross-sectional area than the intake and outlet line 4 or 5 so that when bypass line 8 is connected, a small portion of the oil flow continues to flow through section 1*b*. In other respects, the dimensions of the various cross-sectional areas may be determined as a function of the effect that one wants to achieve. They are calculated in function of the flow rates or the oil throughput quantities using the typical calculation methods for heat exchangers. If necessary, they may also be determined experimentally.

The invention is not limited to the described exemplary embodiment, which may be modified in many different ways. This applies, for example, to the described plate construction of the heat exchanger, since the invention may also be used in tubular or other types of coolers. It is also possible to produce the third collection tank 6 with partition members 22*a*, 22*b* other than those shown. In particular, a partition 24 may be eliminated completely, and a third collection tank may be provided to serve only as a connection to the bypass line 8. If a partition 24 is used, it may also be provided with differently arranged and shaped holes, particularly with differently sized holes. In a design known in the construction of heat exchangers, the two collection tanks 2 and 3 as well as the lines 4 and 5 may also be arranged on the same side of the core 1 rather than on opposite sides, while the third collection tank 6 is arranged on a side of the core 1 opposite thereto.

Other arrangements are also possible since in view of bypassing one of the sections 1*a*, 1*b*, it is only important that the oil flows through said sections in turn. Thus, it would be feasible to assign bypass line 8 to section 1*a* and the first collection tank 2. In this case, during the colder times of the year, the oil would substantially flow initially only through the bypass line 8 and then into the section 1*b* and the collection tank 3 while the section 1*a* would remain partly unused. It is also possible to use more than two core sections 1*a*, 1*b* (e.g. 1*c*) and, correspondingly, more than a third collection tank (e.g. 6*a*) and more than one bypass line (e.g. 8*a*) to permit incremental adjustment of the heat exchanger capacity. The length of the tubes 7*a*, 7*b* may be different. Similarly, additional components may be assigned to the heat exchanger in known manner, particularly at least one fan and an additional bypass line with an additional thermostatic valve that releases the oil flow into the heat exchanger only after the oil has reached an operating temperature of, for example, 150° C. Furthermore, the described heat exchanger may be used to cool liquids other than oil, provided that these liquid congeal at colder temperatures. Finally, the described features may of course be used in combinations different from those shown and described.

It will be understood that each of the elements described above, or two or more together, may also find a useful application in other types of constructions differing from the types described above.

While the invention has been illustrated and described as embodied in a heat exchanger, particularly oil cooler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An oil cooler comprising a core provided with passages for oil and passages for a cooling medium, said core being divided into a first and a second section through which the oil can successively flow; a first collection tank for supplying the oil to said first section and a second collection tank for withdrawing the oil from the second section; a third collection tank interconnecting said sections; a bypass line connected with said third collection tank and in parallel with said second section; and means for gradually activating and deactivating said bypass line between a fully opened state and a fully closed state and for hereby gradually changing an oil flow through said second section between a maximum portion if said bypass line is fully closed and a small remaining portion if said bypass line is fully opened; and a partition provided with holes and dividing said third collection tank into two parts, one of said parts being assigned to said first section, while another of said parts is assigned to said second section, said bypass line being connected with said one of said parts of said third collection tank.

2. An oil cooler according to claim 1; and further comprising an intake line and an outlet line, said first collection tank being connected with said intake line, while said second collection tank is connected with said outlet line, said bypass line opening into said outlet line.

3. An oil cooler according to claim 1, wherein said means include a valve for opening and closing said bypass line.

4. An oil cooler according to claim 3, wherein said valve is such that it is fully closed at high temperatures and fully open at lower temperatures.

5. An oil cooler according to claim 3, wherein said valve is a thermostatic valve.

6. An oil cooler according to claim 3, wherein said valve is such that it passes across a relatively wide temperature range from a first state in which it closes said bypass line and a second state in which it opens said bypass line.

7. An oil cooler according to claim 6, wherein said valve is such that it is fully closed at a temperature of 50° C. and is fully open at a temperature of −10° C.

8. An oil cooler according to claim 1, wherein said bypass line is substantially disposed outside said core.

9. An oil cooler according to claim 1, wherein said holes in said partition are distributed in a predetermined pattern such that said oil flow through said second section is distributed in a manner to reduce thermal stresses.

10. An oil cooler according to claim 2, wherein said intake line and said outlet line have flow cross-sections of an equal size.

11. An oil cooler according to claim 1, wherein said holes in said partition have cross-sectional areas whose sum corresponds to flow cross-sections of said intake line or said outlet line.

12. An oil cooler according to claim 1, wherein all said holes of said partition have a same cross-sectional area.

* * * * *